US009756915B2

(12) United States Patent
Nguyen et al.

(10) Patent No.: US 9,756,915 B2
(45) Date of Patent: Sep. 12, 2017

(54) CASE FOR MOBILE ELECTRONIC DEVICE WITH MOVABLE SENSOR COVER

(71) Applicants: Quang Nguyen, Prescott Valley, AZ (US); Shawn Alstad, Phoenix, AZ (US)

(72) Inventors: Quang Nguyen, Prescott Valley, AZ (US); Shawn Alstad, Phoenix, AZ (US)

( * ) Notice: Subject to any disclaimer, the term of this patent is extended or adjusted under 35 U.S.C. 154(b) by 102 days.

(21) Appl. No.: 14/659,726

(22) Filed: Mar. 17, 2015

(65) Prior Publication Data

US 2015/0320167 A1 Nov. 12, 2015

Related U.S. Application Data

(60) Provisional application No. 61/990,106, filed on May 8, 2014.

(51) Int. Cl.

| | |
|---|---|
| ***H04M 1/00*** | (2006.01) |
| ***A45C 11/00*** | (2006.01) |
| ***A45F 5/00*** | (2006.01) |

(52) U.S. Cl.

CPC ..... *A45C 11/00* (2013.01); *A45F 5/00* (2013.01); *A45C 2011/002* (2013.01); *A45C 2011/003* (2013.01); *A45C 2200/00* (2013.01)

(58) Field of Classification Search

CPC .. H04M 1/025; A45C 11/00; A45C 2011/002; A45C 2011/003; A45F 5/00

USPC ..... 455/575.1, 575.4

See application file for complete search history.

(56) References Cited

U.S. PATENT DOCUMENTS

2011/0279897 A1* 11/2011 Ohuchi ..... G03B 11/043 359/511

2014/0333831 A1* 11/2014 Oh ..... H04N 5/2254 348/376

* cited by examiner

*Primary Examiner* — Timothy Pham

(74) *Attorney, Agent, or Firm* — Griffiths & Seaton PLLC

(57) ABSTRACT

Embodiments described herein provide cases for mobile electronic devices. The cases may include a body configured to be selectively secured to a mobile electronic device having at least one sensor proximate to an outer surface thereof and a cover slidably coupled to the body. The cover is slidable between a first position and a second position relative to the body such that when the cover is in the first position, the at least one sensor is blocked by the cover and when the cover is in the second position, the at least one sensor is not blocked by the cover.

19 Claims, 8 Drawing Sheets

CASE FOR MOBILE ELECTRONIC DEVICE WITH MOVABLE SENSOR COVER

RELATED APPLICATION

This application claims the priority benefits of U.S. Provisional Application No. 61/990,106, filed May 8, 2014, which is incorporated in its entirety by reference herein.

TECHNICAL FIELD

This disclosure relates to cases for mobile electronic devices, such as cell phones, tablets, laptop computers, etc. In particular, this disclosure related to cases for mobile electronic devices with movable sensor covers.

BACKGROUND

Recent developments have brought on increased privacy concerns with respect to mobile electronic devices, such as mobile phones, tablets, laptop (or notebook) computers, etc. In particular, some users are concern that their mobile devices may be "hacked" in such a way that a third party may be able to remotely access their mobile electronic device and use the camera and/or microphone on the mobile electronic device to obtain personal information (e.g., images, sounds, etc.).

Even if the user deactivates the particular sensor(s) (e.g., a camera or microphone), there is still a concern that a third may be able to re-activate the sensor remotely. Thus, it is desirable to provide a simple, low cost system for physically blocking the sensor(s) such that even if the mobile electronic device is hacked, the sensor(s) can not be used to obtain any personal information of the rightful owner of the phone.

BRIEF DESCRIPTION OF THE DRAWINGS

The present disclosure is illustrated by way of example, and not by way of limitation, in the figures of the accompanying drawings.

DETAILED DESCRIPTION

Reference in the description to "one embodiment" or "an embodiment" means that a particular feature, structure, or characteristic described in connection with the embodiment is included in at least one embodiment of the invention. The phrase "in one embodiment" located in various places in this description does not necessarily refer to the same embodiment.

In the following detailed description, for purposes of explanation, numerous specific details are set forth in order to provide a thorough understanding of the subject matter of the present application. It will be evident, however, to one skilled in the art that the disclosed embodiments, the claimed subject matter, and their equivalents may be practiced without these specific details.

The detailed description includes references to the accompanying drawings, which form a part of the detailed description. The drawings show illustrations in accordance with example embodiments. These embodiments, which may also be referred to herein as "examples," are described in enough detail to enable those skilled in the art to practice the embodiments of the claimed subject matter described herein. The embodiments may be combined, other embodiments may be utilized, or structural, logical, and electrical changes may be made without departing from the scope and spirit of the claimed subject matter. It should be understood that the embodiments described herein are not intended to limit the scope of the subject matter but rather to enable one skilled in the art to practice, make, and/or use the subject matter.

Figure 1:
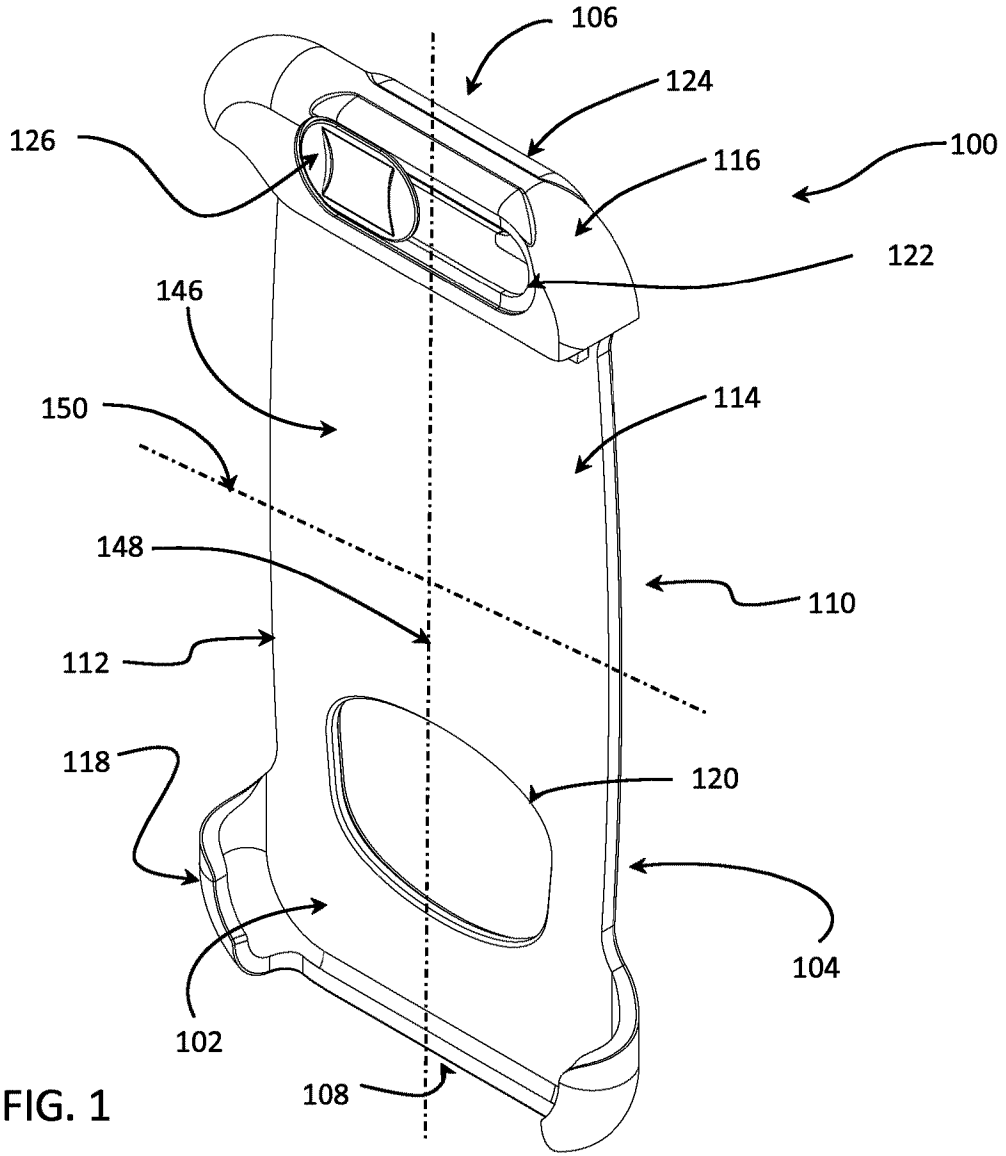
FIG. 1 is an isometric view of a case for a mobile electronic device according to some embodiments.
Figure 2:
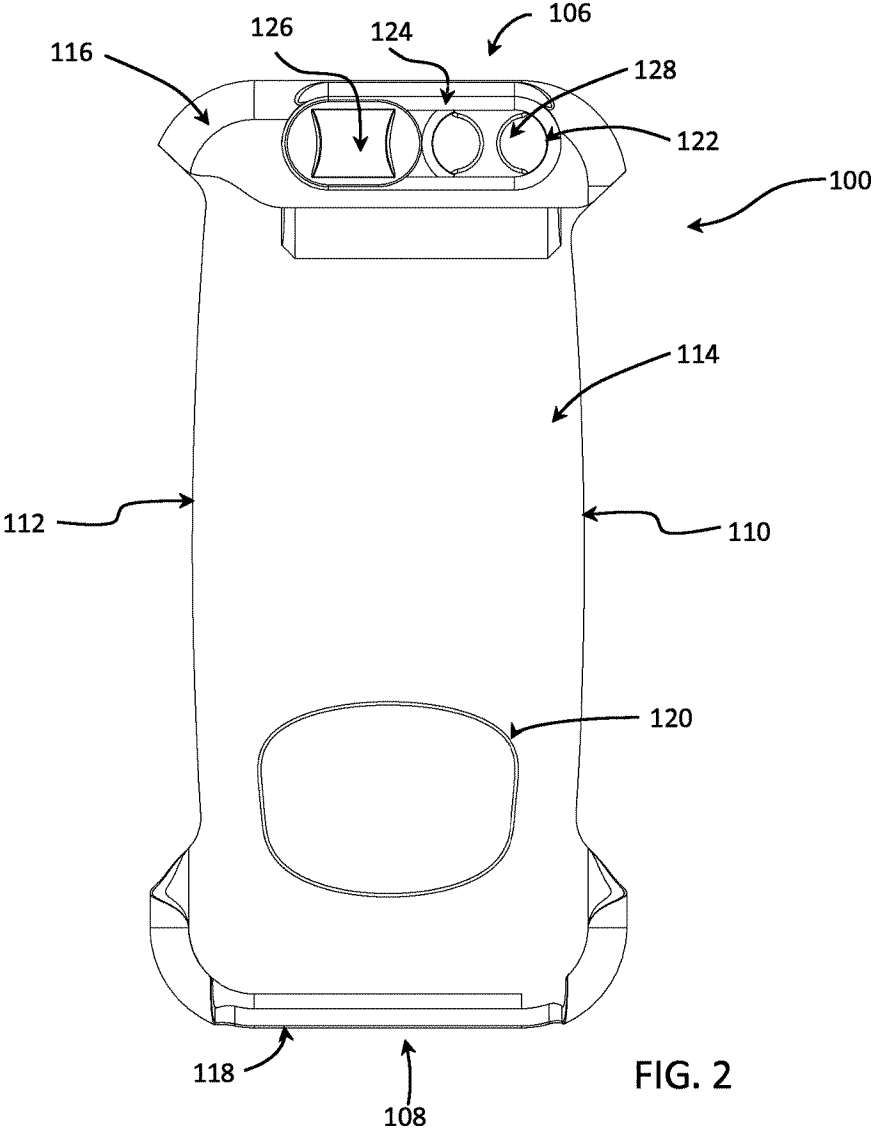
FIG. 2 is a plan view of the case of FIG. 1.

FIGS. 1 and 2 illustrate a case (or cover) 100 for a mobile electronic device, according to some embodiments. In the depicted embodiment, the case 100 generally has a rectangular shape with a front side 102, a back side 104, a top end 106, a bottom end 108, and lateral edges 110 and 112. The case 100 includes a main piece (or portion) 114, a top piece 116, and a bottom piece 118. In the depicted embodiment, the main piece 114 is a substrate with a substantially rectangular shape that extends along the back side 104 of the case 100. As shown, the main piece 114 has an opening 120 formed therethrough near the bottom end 108 of the case 100.

The top piece 116 of the case 100 is connected to the main piece 114 at an end thereof near the top end 106 of the case 100 (e.g., at an upper end of the main piece 114). As will be shown in greater detail below, the top piece 116 is shaped to form a pocket (or at least a portion of a cove or pocket) in that portions of the top piece 116 extend along at least two opposing sides of the case 100 (e.g., the front side 102 and the back 104 and/or the lateral edges 110 and 112) such that a gap extends between those portions.

Still referring to FIGS. 1 and 2, the top piece 116 has a (first) cover hole (or opening) 122 formed through a portion thereof along the front side 102 of the case. In the depicted embodiment, the cover hole 122 has an elongate shape with a longer dimension thereof (e.g., a width) that extends laterally between the lateral edges 110 and 112 of the case 100. In some embodiments, such as that shown in the figures, a second cover hole 124 may similarly be formed through a portion of the top piece 116 (and/or the main piece 114) along the back side 104 of the case 100. In some embodiments, the second cover hole 124 may have substantially the same size, shape, and orientation as the first cover hole 122.

As shown in FIGS. 1 and 2, a (first) cover 126 is at least partially positioned within the cover hole 122. The cover 126 may have a height that is substantially the same as that of the cover hole 122 and a width that is significantly less than that of the cover hole 122 so that the cover 126 may only block (or "cover") a portion of the cover hole 122, while the other portion(s) of the cover hole 122 remain unblocked or exposed. In the depicted embodiment, a second cover 128 is at least partially positioned within the second cover hole 124 and may be similarly sized and shaped as the first cover 126, both in absolute terms and with respect to the second cover hole 124.

Figure 3:
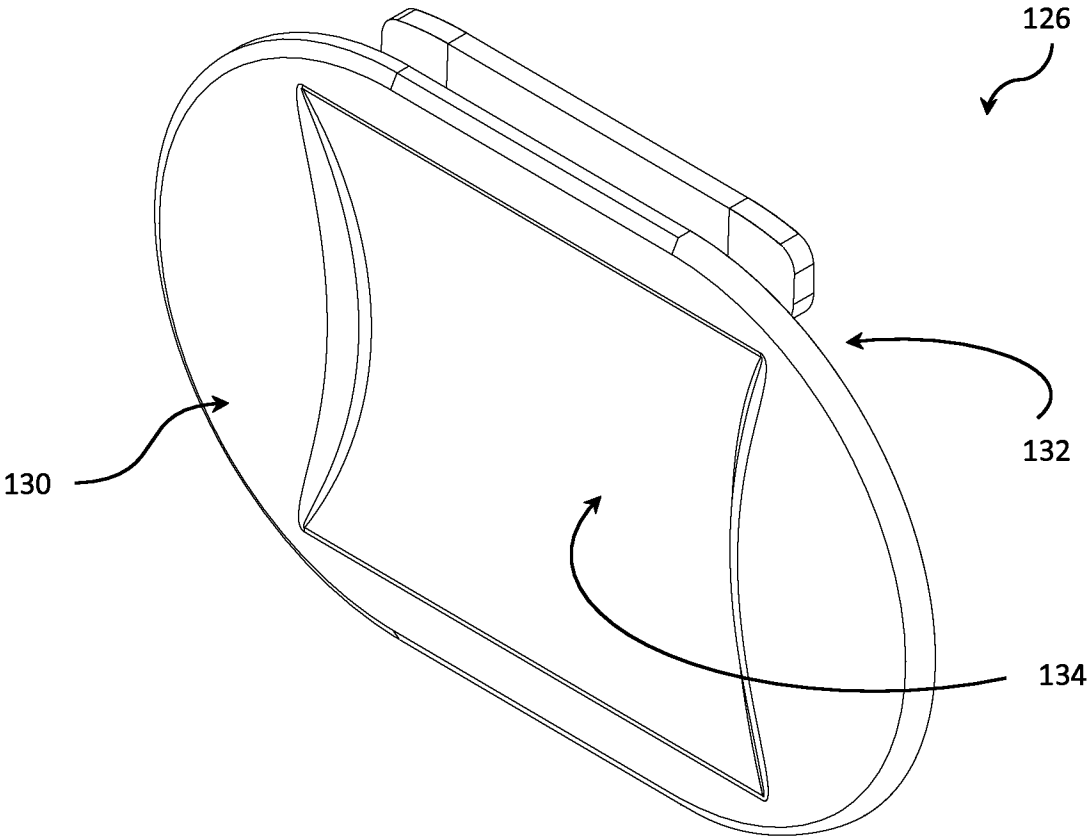
FIG. 3 is an isometric view of a movable cover of the case of FIG. 1 as viewed from a front side thereof.
Figure 4:
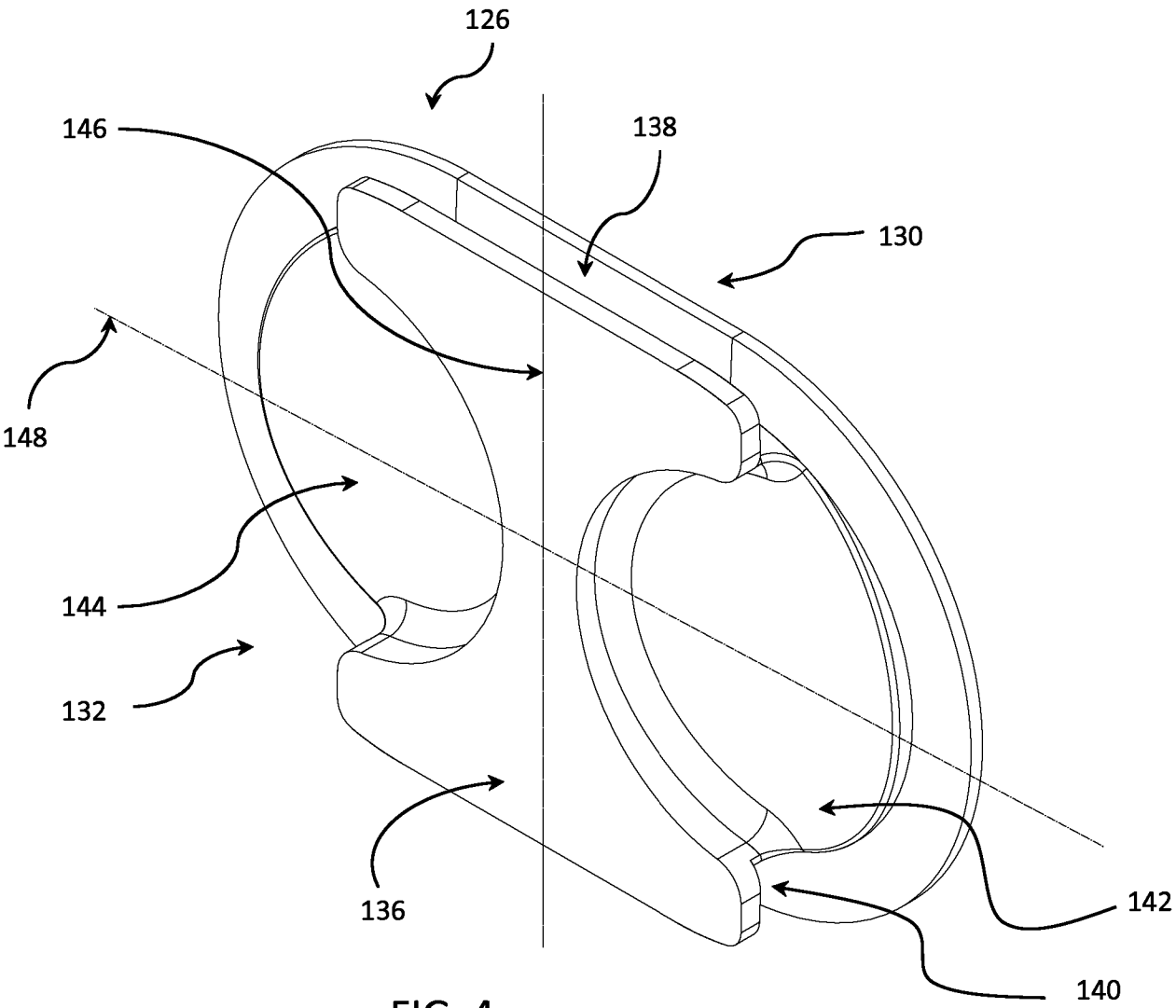
FIG. 4 is an isometric view of the movable cover of FIG. 3 as viewed from a back side thereof.

FIGS. 3 and 4 illustrate the first cover 126 according to some embodiments. In the depicted embodiment, the first cover 126 is substantially oval in shape and has a front (or outer) side 130 and a back (or inner) side 132. On the front side 130 of the first cover 126, an indentation (or depression) 134 is formed which, as will be described in greater detail below, may facilitate the first cover 126 being manually moved (or slid) by a user. In some embodiments, texturing may be added to at least a portion of the front side 130 of the first cover 126 to provide additional "grip" for the user, with or without the indention 134.

Referring specifically to FIG. 4, in the depicted embodiment, a protrusion 136 extends from the back side 132 of the first cover 126. The protrusion 136 is shaped such that grooves 138 and 140 are respectively formed on the back side 132 of the first cover 126 along a top and bottom edges thereof. The protrusion 136 is also shaped with "cut-outs" (e.g., semi-circular cut-outs) such that voids, or pockets, 142 and 144 are formed along the sides thereof on the back side 132 of the first cover 126.

In some embodiments, the first cover 126 is symmetrical about a vertical axis 146 and a horizontal axis 148 (i.e., the halves of the first cover 126 on opposing sides of the vertical axis 146, as well as the horizontal axis 148, are mirror images of each other). Thus, the first cover 126 may be installed with either groove 138 at the top or groove 140 at the top (i.e., the cover 126 can not be installed "upside down" per se). It should also be noted that in some embodiments, installation of the first cover 126 may be facilitated by flexing the first cover 126 along the vertical axis 146 and/or the horizontal axis 148. Further, although not specifically shown, in some embodiments, the second cover 128 is identical, or at least substantially identical, to the first cover 126.

As is described in greater detail below, when the first cover 126 is installed within the first cover hole 122, the inner edges of the first cover hole 122 mate with the grooves 138 and 140 on the back side 132 of the first cover 126. The second cover 128 may fit within the second cover hole 124 in a similar manner.

Referring again to FIG. 1, the bottom piece 118 of the case 100 is connected to the main piece 114 at an end thereof near the bottom end 108 of the case 100 (e.g., at a lower end of the main piece 114). In a manner similar to the top piece 116, the bottom piece 118 is shaped to form a pocket (or at least a portion of a cove or pocket) in that portions of the bottom piece 116 extend along at least two opposing sides of the case 100 (e.g., the front side 102 and the back 104 and/or the lateral edges 110 and 112), at least at the lower corners of the main piece 114, such that a gap extends between those portions.

The overall effect of the sizes and shapes of the main piece 114, the top piece 116, and the bottom piece 118 of the case 100 is that a cove (or pocket) 146 is formed between (and/or by) the top piece 116 and the bottom piece 118 on a side of the main piece 114 adjacent to the front side 102 of the case 100. The cove 146, and/or the case 100 as a whole, is configured to receive a mobile electronic device (e.g., a mobile phone, a tablet, etc.) so that the case 100 may be selectively secured to the mobile electronic device.

In some embodiments, the main piece 114, the top piece 116, and the bottom piece 118, perhaps as well as the first and second covers 126 and 128, are made of a flexible yet firm and resilient material, such as a rubber or soft plastic. Installation of the case 100 onto the mobile electronic device may be facilitated by flexing or bending the case 100 along vertical axis 148 and/or horizontal axis 150. For example, the case 100 may be bent "backwards" (i.e., towards the back side 104 thereof) along the horizontal axis 150 so that opposing ends of the mobile electronic device may be easily inserted into the pockets formed by the top piece 116 and the bottom piece 118. The opening 120 (or the shape/size thereof) formed through the main piece 114 of the case 100 may be used to control the "flex" properties of the case 100 as a whole, while also allowing for a logo, or other information, on the mobile electronic device to be viewed.

After installation, due to the resiliency of the material of the case 100, the case 100 may return to it's original shape such that the cove 146 perfectly conforms to the size and shape of the mobile electronic device. As such, embodiments of the case 100 may vary in certain dimensions (e.g., size/shape of the main piece 114, depth of the pockets formed by the top and bottom pieces 116 and 118, size/shape/position of the cover hole(s) and the cover(s), etc.) to match the dimensions of different mobile electronic devices.

FIGS. 5-8 illustrate the case 100 installed on, or secured to, a mobile electronic device 152. The mobile electronic device may be, for example, a mobile phone, a laptop computer, a tablet, a smart watch, or any other mobile device which includes audio/video components, such as a camera, microphone, speaker, etc. In the depicted embodiment, the mobile electronic device (or simply "device") 152 is a mobile phone. As is apparent in the figures, the overall size and shape of the device 152 is substantially identical to that of the cove 146 (FIG. 1) formed by the case 100. A top end 154 of the device 152 is inserted into the pocket formed by the top piece 116 of the case 100, while a bottom end 156 of the device 152 is inserted into the pocket formed by the bottom piece 118 of the case.

In the depicted embodiment, at the top end 154 of the device 152, on a side thereof adjacent to the front side 102 of the case 100, the device has at least one audio/video component formed thereon. The audio/video components may be a sensor, such as a camera or a microphone, or a speaker. In the depicted embodiment, the audio/video components include a camera (i.e., a first/front camera) 158 and a speaker 160. In some embodiments, the device 152 also has audio/video components formed at the top end 154 on the side thereof adjacent to the back side 104 of the case 100, in particular, a back/second camera 162 and a microphone 164.

Figure 5:
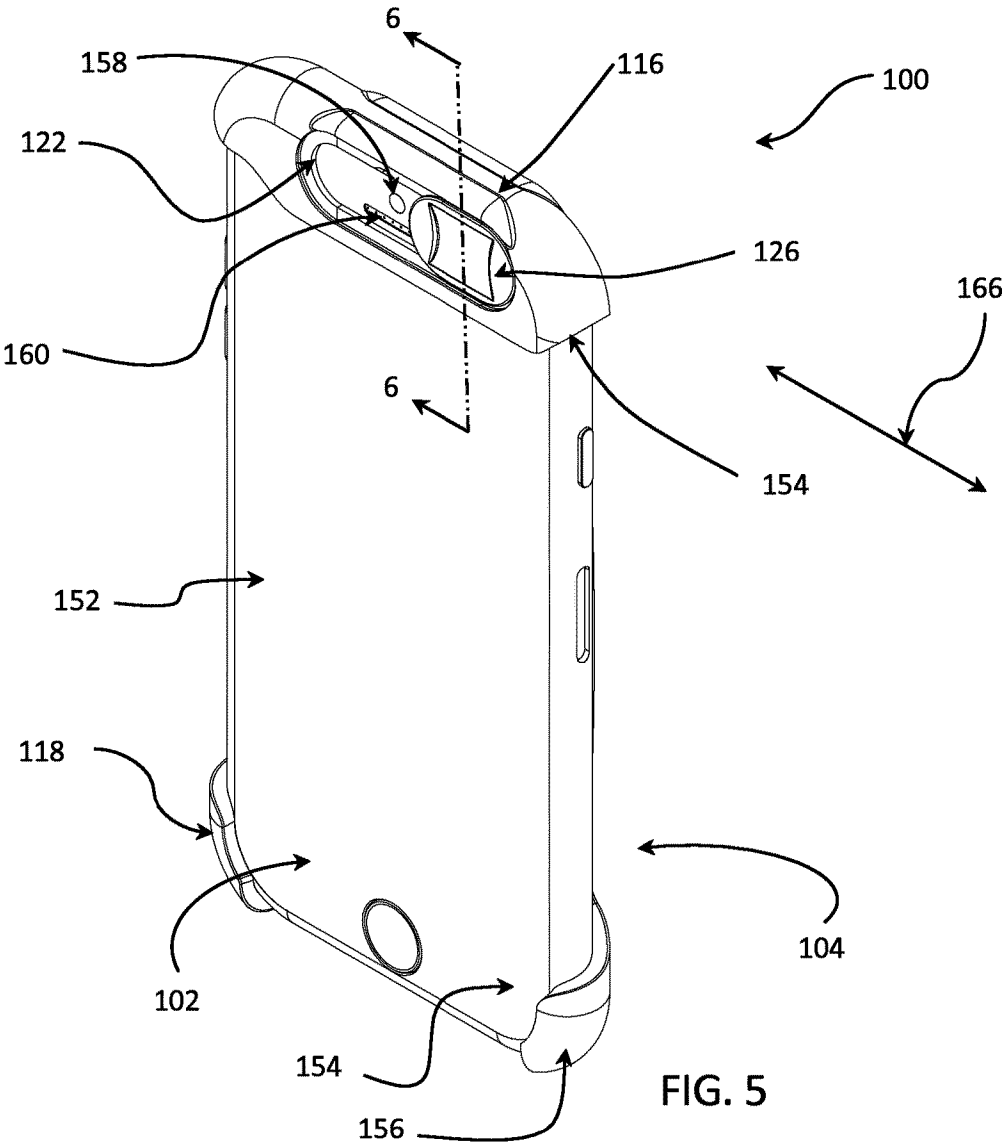
FIG. 5 is an isometric view of the case of FIG. 1 installed on a mobile electronic device.

Referring specifically to FIG. 5, the front camera 158 and the speaker 160 are positioned relative to the first cover hole 122 such that they are exposed though the first cover hole 122, depending on the position of the first cover 126 within the first cover hole 122. More specifically, as configured in FIG. 5, the first cover 126 is positioned within the first cover hole 122 such that the front camera 158 and the speaker 160 are exposed through the first cover hole 122 and not covered (or blocked) by the first cover 126.

Figure 6:
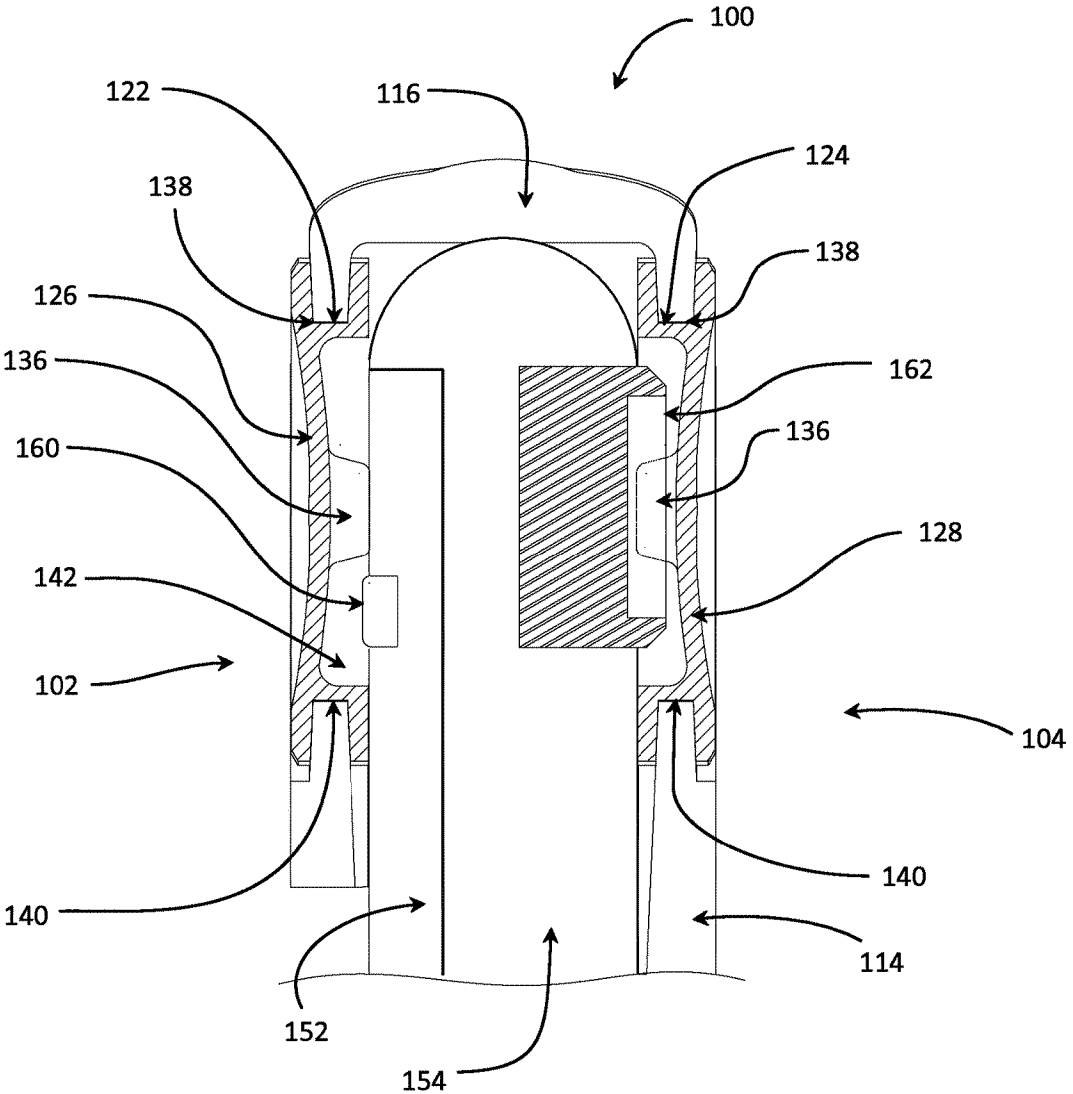
FIG. 6 is a cross-sectional view of the case and the mobile electronic device of FIG. 5 taken along line 6-6.

As shown in FIG. 6, the first and second covers 126 and 128 are respectively positioned within the first and second cover holes 122 and 124 such that the grooves 138 and 140 formed on the back side 132 thereof mate with the inner edges of the first and second cover holes 122 and 124. The result is that the inner edges of the first and second cover holes 122 and 124 serve as "tracks" for the first and second covers 126 and 128. When combined with the relative widths of the first and second covers 126 and 128 and the first and second cover holes 122 and 124, this mating allows the first and second covers 126 and 128 to be manually slid (e.g., using a finger) into various positions within the first and second cover holes 122 and 124.

FIG. 6 also shows how the top piece 116 of the case 100 "wraps around" the top end 154 of the device 152. For example, portions of the top piece 116 lie on (e.g., contact)

opposing sides (e.g., the side of the device associated with the front side 102 and the side of the device associated with the back side 104) of the device 152. Although not specifically shown, it should be understood that the bottom end 156 of the device 152 may fit into the bottom piece 118 of the case in a similar manner. Thus, it should be noted that in at least some embodiments, all four corners of the device 152 are covered, and thus protected, by the case 100, which may help absorb impact and minimize damage to the device 152 if the device 152 is dropped.

Still referring to FIG. 6, in at least some embodiments, at least a portion of the first cover 126 (and/or the second cover 128) contacts the device 152. In particular, in the depicted embodiment, the protrusions 136 on the back sides 132 of the first and second covers 126 and 128 contact the device 152. However, due to the shape of the protrusions 136 (and/or the covers 126 and 128 as a whole), gaps are formed between portions of the covers 126 and 128 and the device 152. In particular, the gaps may be formed by the voids 142 and 144 formed on the back sides 132 of the covers 126 and 128. These gaps may be useful for covering audio/video components that stand proud of (or extend from) the device 152, such as the speaker 160 and the rear camera 162 of the device 152, as is shown in FIG. 6, where the speaker 160 and the rear camera 162 extend into the voids 142 and 144. This may be particularly useful when the audio/video component is a speaker, as the gaps may facilitate the propagation of sound from the speaker (e.g., so that the user may still be able to hear sound coming from the speaker) while camera 158 is blocked.

Referring now to FIG. 5 in combination with FIG. 6, in order to move the covers 126 and 128, a force may manually be applied to the covers 126 and 128 (e.g., using a finger) in directions indicated by arrow 166, thus causing the covers 126 and 128 to slide within the first and second cover holes 122 and 124, respectively. In this manner, the covers 126 and 128 may be selectively positioned with the cover holes 122 and 124 to either block the various audio/video components on the device 152 (e.g., cameras 158 and 162) or leave the components exposed, and thus otherwise operational.

The contact between the covers 126 and 128 and the device 152, as well as friction between the grooves 138 and 140 on the covers 126 and 128 and the inner edges of the cover holes 122 and 124, may prevent the covers 126 and 128 from moving (i.e., undesirably) within the cover holes 122 and 124 unless an external force is manually applied, and may also prevent the covers 126 and 128 from falling out and/or being removed from the cover holes 122 and 124 while the case 100 is installed on the device. Thus, the case 100 provides a simple, easy-to-use, and reliable manner to block the audio/video components on the device 152.

Figure 7:
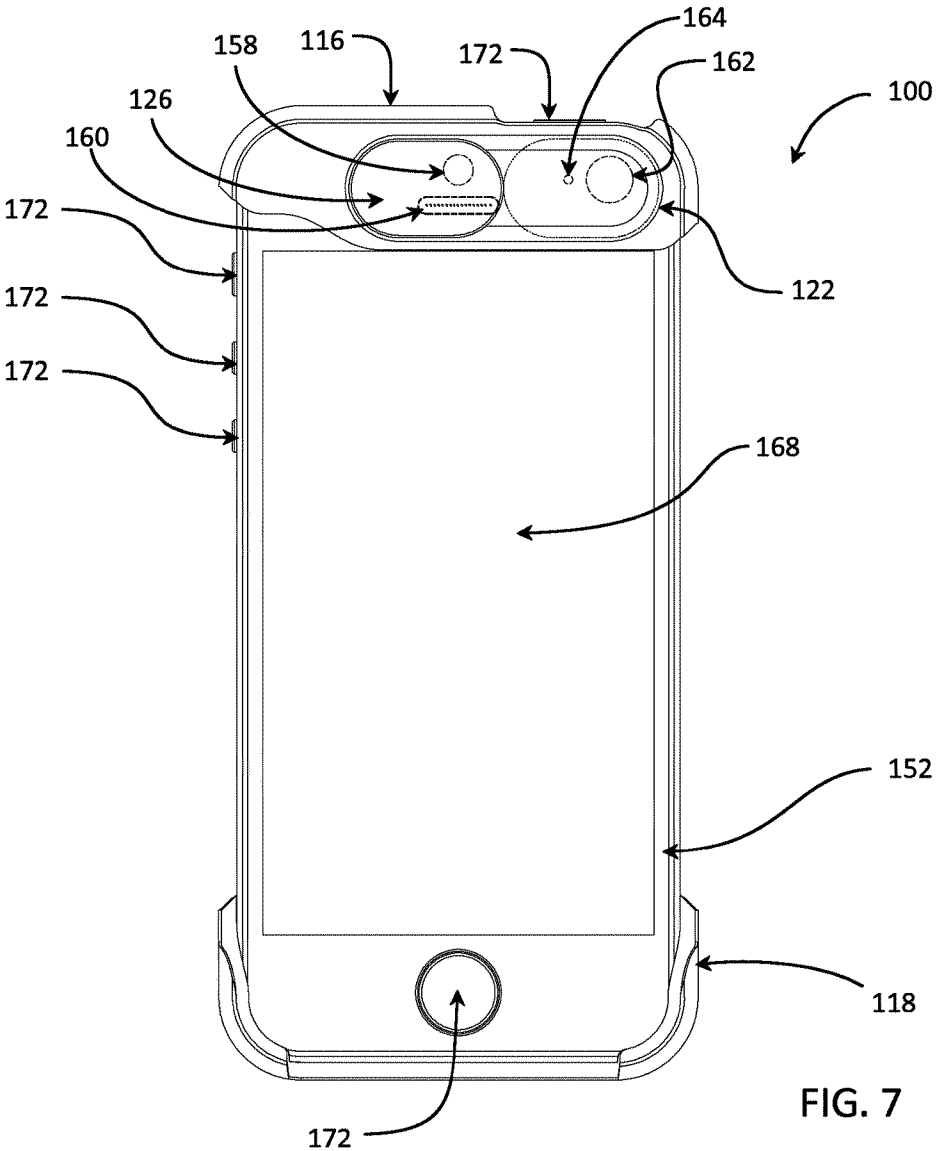
FIG. 7 is a plan view of the case and the mobile electronic device of FIG. 5.
Figure 8:
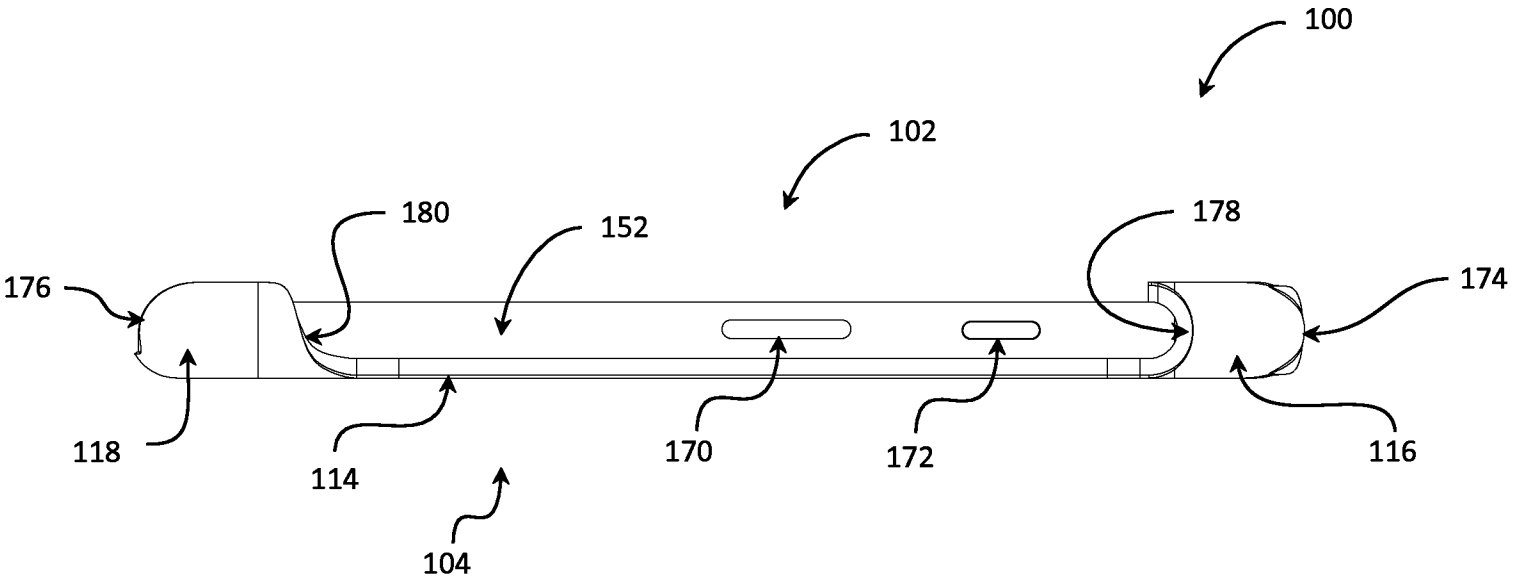
FIG. 8 is a side view of the case and the mobile electronic device of FIG. 5.

Referring to FIGS. 7 and 8, in at least some embodiments, the case 100 is sized and shape such that access to various features on the device 152 are still accessible by the user. In particular, in the depicted embodiment, a screen 168, an access port 170, and input buttons 172 on the device 152 are left exposed so that the user may still use those features. In the particular embodiment shown in FIG. 7, the top piece 116 has an extra opening formed therethrough such that an input button 172 on the upper edge of the device 152 is accessible.

Referring specifically to FIG. 8, in some embodiments, the case 100 is shaped such that the outermost surfaces on the front side 102 and the back side 104 are substantially planar, even with the covers 126 and 128 installed, so that the case 100 (and/or the mobile device 152) may "sit flat" on a surface (e.g., a table) to, for example, prevent phone rocking while texting or dialing. Further, in some embodiments, the case 100 is shaped in manner so as to minimize "sharp" corners to, for example, prevent the case 100 from catching on clothing when being removed from, or inserted into, a pocket. This is evident with, for example, the rounded shape of the ends 174 and 176 of the top piece 116 and the bottom piece 118 of the case 100, respectively, as well as the "tapered" shape of the interfaces 178 and 180 between the top piece 116 and the bottom piece 118 and the main piece 114 of the case 100.

Thus, in some embodiments, a case a mobile electronic device is provided. The case includes a body configured to be selectively secured to a mobile electronic device having at least one sensor proximate to an outer surface thereof and a cover slidably coupled to the body. The cover is slidable between a first position and a second position relative to the body such that when the cover is in the first position, the at least one sensor is blocked by the cover and when the cover is in the second position, the at least one sensor is not blocked by the cover.

The body may include a cover hole formed therethrough, and the cover may be at least partially positioned within the cover hole. The cover hole may have a width that is greater than a width of the cover. The width of the cover hole may be less than a width of the body.

One of the cover and an inner edge of the cover hole may have a groove formed thereon, and a portion of the other of the cover and the inner edge of the cover hole may be positioned within the groove. The groove may be formed on the cover, and a portion of the inner edge of the cover hole may be positioned within the groove.

The body may further include a first portion and a second portion and is shaped such that a gap extends between the first portion and the second portion. The gap may be sized to receive the mobile electronic device, and when the body is secured to the mobile electronic device, the mobile electric device may be at least partially positioned with the gap, the first portion of the body may be in contact with a first side of the mobile electronic device, and the second portion may be in contact with a second side of the mobile electronic device. The second side of the mobile electronic device may oppose the first side of the mobile electronic device.

The cover hole may be formed through the first portion of the body. The body may further include a second cover hole formed through the second portion thereof and a second cover slidably coupled to the body and at least partially positioned within the second cover hole. The second cover hole may have a width that is greater than a width of the second cover. The cover may be shaped such that the cover is in contact with the first side of the mobile electronic device when the body is secured to the mobile electronic device. The cover may be shaped such that a gap is formed directly between a portion of the cover and the first side of the mobile electronic device.

In some embodiments, a case for a mobile electronic device is provided. The case includes a body configured to be selectively secured to a mobile electronic device. The body includes a cover hole formed therethrough. The cover hole has a first width. A cover is slidably coupled to the body and at least partially positioned with the cover hole. The cover has a second width. The second width is less than the first width. The cover is slidable between a first position and a second position within the cover hole.

The body may have a third width. The third width may be greater than the first width. The cover may have a groove formed thereon. An inner edge of the cover hole may be positioned within the groove. The body may further include a second cover hole formed therethrough. A second cover may be slidably coupled to the body and at least partially positioned with the second cover hole.

The body may further include a first portion and a second portion and is shaped such that a gap extends between the first portion and the second portion. The cover hole may be formed through the first portion of the body, and the second cover hole may be formed through the second portion of the body. The gap may be sized to receive the mobile electronic device. When the body is secured to the mobile electronic device, the mobile electric device may be at least partially positioned with the gap, the first portion of the body may be in contact with a first side of the mobile electronic device, and the second portion may be in contact with a second side of the mobile electronic device. The second side of the mobile electronic device may oppose the first side of the mobile electronic device.

In some embodiments, a case for a mobile electronic device is provided. The case includes a body configured to be selectively secured to a mobile electronic device. The body includes a first portion having a first cover hole formed therethrough and a second portion having a second cover hole formed therethrough and is shaped such that a gap extends between the first portion and the second portion. When the body is secured to the mobile electronic device, the mobile electric device is at least partially positioned with the gap, the first portion of the body is in contact with a first side of the mobile electronic device, and the second portion is in contact with a second side of the mobile electronic device. The second side of the mobile electronic device opposes the first side of the mobile electronic device. A first cover is slidably coupled to the body and at least partially positioned within the first cover hole. The first cover has a width that is less than a width of the first cover hole and is slidable between a plurality of positions within the first cover hole. A second cover is slidably coupled to the body and at least partially positioned within the second cover hole. The second cover has a width that is less than a width of the second cover hole and is slidable between a plurality of positions within the second cover hole.

The first cover hole and the first cover may be configured such that when the body is secured to the mobile electronic device and the first cover is in a first position within the first cover hole, a first sensor on the first side of the mobile electronic device is blocked by the first cover, and when the body is secured to the mobile electronic device and the first cover is in a second position within the first cover hole, the first sensor is not blocked by the first cover. The second cover hole and the second cover may be configured such that when the body is secured to the mobile electronic device and the second cover is in a first position within the second cover hole, a second sensor on the second side of the mobile electronic device is blocked by the second cover, and when the body is secured to the mobile electronic device and the second cover is in a second position within the second cover hole, the second sensor is not blocked by the second cover.

The first cover may have a first groove formed thereon, and an inner edge of the first cover hole may be positioned within the first groove. The second cover may have a second groove formed thereon, and an inner edge of the second cover hole may be positioned within the second groove.

The mobile electronic device may include a mobile phone, a laptop computer, a tablet, a smart watch, or a combination thereof. Each of the first sensor and the second sensor may include a camera, a microphone, or a combination thereof.

Although the foregoing examples have been described in some detail for purposes of clarity of understanding, the invention is not limited to the details provided. There are many alternative ways of implementing the invention. The disclosed examples are illustrative and not restrictive.

What is claimed is:

1. A case for a mobile electronic device, comprising:

a body configured to be selectively secured to a mobile electronic device having at least one sensor proximate to an outer surface thereof;

a first cover slidably coupled to a front portion of the body, wherein the first cover is slidable between a first position and a second position relative to the body such that when the first cover is in the first position, at least one sensor is blocked by the first cover and when the first cover is in the second position, at least one sensor is not blocked by the first cover; and a second cover slidably coupled to a rear portion of the body, wherein the second cover is slidable between a first position and a second position relative to the body such that when the second cover is in the first position, at least one sensor is blocked by the second cover and when the second cover is in the second position, at least one sensor is not blocked by the second cover.

2. The case of claim 1, wherein the body comprises a first and second cover hole formed therethrough, and the first and second cover is at least partially positioned within the first and second cover hole, respectively.

3. The case of claim 2, wherein the first and second cover hole has a width that is greater than a width of the first and second cover, respectively.

4. The case of claim 3, wherein the width of the first and second cover hole is less than a width of the body.

5. The case of claim 4, wherein one of the first and second cover and an inner edge of each of the first and second cover hole has a groove formed thereon, and wherein a portion of the other of the first and second cover and the inner edge of the first and second cover hole is positioned within the groove.

6. The case of claim 5, wherein the groove is formed on the first and second cover, and a portion of the inner edge of the first and second cover hole is positioned within the groove.

7. The case of claim 4, wherein the body further comprises a first portion being the front portion and a second portion being the rear portion and is shaped such that a gap extends between the first portion and the second portion, the gap being sized to receive the mobile electronic device, and wherein when the body is secured to the mobile electronic device, the mobile electric device is at least partially positioned with the gap, the first portion of the body is in contact with a first side of the mobile electronic device, and the second portion is in contact with a second side of the mobile electronic device, the second side of the mobile electronic device opposing the first side of the mobile electronic device.

8. The case of claim 7, wherein the first cover hole is formed through the first portion of the body, the body further comprises a second cover hole formed through the second portion thereof, and further comprising the second cover slidably coupled to the body and at least partially positioned within the second cover hole, wherein the second cover hole has a width that is greater than a width of the second cover.

9. The case of claim 7, wherein the first cover is shaped such that the first cover is in contact with the first side of the mobile electronic device when the body is secured to the mobile electronic device, and the second cover is shaped such that the second cover is in contact with the second side of the mobile electronic device when the body is secured to the mobile electronic device.

10. The case of claim 9, wherein the first cover is shaped such that a gap is formed directly between a portion of the first cover and the first side of the mobile electronic device, and the second cover is shaped such that a gap is formed directly between a portion of the second cover and the second side of the mobile electronic device.

11. A case for a mobile electronic device, comprising:

a body configured to be selectively secured to a mobile electronic device, wherein the body comprises a first and second cover hole formed therethrough, the first and second cover hole each having a first width;

a first cover slidably coupled to a front portion of the body and at least partially positioned with the first cover hole, wherein the first cover has a second width, the second width being less than the first width, and wherein the first cover is slidable between a first position and a second position within the first cover hole; and a second cover slidably coupled to a rear portion of the body and at least partially positioned with the second cover hole, wherein the second cover has a second width, the second width being less than the first width, and wherein the second cover is slidable between a first position and a second position within the second cover hole.

12. The case of claim 11, wherein the body has a third width, wherein the third width is greater than the first width.

13. The case of claim 12, wherein the first and second cover each have a groove formed thereon, and an inner edge of the first and second cover hole is positioned within the groove.

14. The case of claim 11, wherein the body further comprises a first portion being the front portion and a second portion being the rear portion and is shaped such that a gap extends between the first portion and the second portion, the first cover hole being formed through the first portion of the body and the second cover hole being formed through the second portion of the body, and wherein the gap is sized to receive the mobile electronic device, and when the body is secured to the mobile electronic device, the mobile electric device is at least partially positioned with the gap, the first portion of the body is in contact with a first side of the mobile electronic device, and the second portion is in contact with a second side of the mobile electronic device, the second side of the mobile electronic device opposing the first side of the mobile electronic device.

15. A case for a mobile electronic device, comprising:

a body configured to be selectively secured to a mobile electronic device, wherein the body comprises a first portion being a front portion having a first cover hole formed therethrough and a second portion being a rear portion having a second cover hole formed therethrough and is shaped such that a gap extends between the first portion and the second portion and when the body is secured to the mobile electronic device, the mobile electric device is at least partially positioned with the gap, the first portion of the body is in contact with a first side of the mobile electronic device, and the second portion is in contact with a second side of the mobile electronic device, the second side of the mobile electronic device opposing the first side of the mobile electronic device;

a first cover slidably coupled to the body and at least partially positioned within the first cover hole, wherein the first cover has a width that is less than a width of the first cover hole and is slidable between a plurality of positions within the first cover hole; and a second cover slidably coupled to the body and at least partially positioned within the second cover hole, wherein the second cover has a width that is less than a width of the second cover hole and is slidable between a plurality of positions within the second cover hole.

16. The case of claim 15, wherein the first cover hole and the first cover are configured such that when the body is secured to the mobile electronic device and the first cover is in a first position within the first cover hole, a first sensor on the first side of the mobile electronic device is blocked by the first cover, and when the body is secured to the mobile electronic device and the first cover is in a second position within the first cover hole, the first sensor is not blocked by the first cover, and wherein the second cover hole and the second cover are configured such that when the body is secured to the mobile electronic device and the second cover is in a first position within the second cover hole, a second sensor on the second side of the mobile electronic device is blocked by the second cover, and when the body is secured to the mobile electronic device and the second cover is in a second position within the second cover hole, the second sensor is not blocked by the second cover.

17. The case of claim 16, wherein the first cover has a first groove formed thereon, and an inner edge of the first cover hole is positioned within the first groove, and wherein the second cover has a second groove formed thereon, and an inner edge of the second cover hole is positioned within the second groove.

18. The case of claim 17, wherein the mobile electronic device comprises a mobile phone, a laptop computer, a tablet, a smart watch, or a combination thereof.

19. The case of claim 18, wherein each of the first sensor and the second sensor comprises a camera, a microphone, or a combination thereof.

* * * * *